United States Patent [19]

Person et al.

[11] Patent Number: 4,692,655

[45] Date of Patent: Sep. 8, 1987

[54] PLASMA DISPLAY HAVING HEATER AND METHOD OF MAKING SAME

[75] Inventors: Herman R. Person; Dennis L. Raesner; Gayle L. Meints, all of Columbus, Nebr.

[73] Assignee: Dale Electronics, Inc., Columbus, Nebr.

[21] Appl. No.: 797,921

[22] Filed: Nov. 14, 1985

[51] Int. Cl.[4] ..... H01J 17/49; H01J 7/24

[52] U.S. Cl. ..... 313/15; 313/517; 313/518; 313/519; 445/25; 315/115

[58] Field of Search ..... 313/15, 518, 586, 582, 313/517, 519; 445/25; 315/114, 115

[56] References Cited

U.S. PATENT DOCUMENTS

| | | | |
|---|---|---|---|
| 1,839,502 | 1/1932 | Rudenberg et al. . | |
| 2,581,959 | 1/1952 | Koehler . | |
| 3,177,345 | 4/1965 | Plumat . | |
| 3,614,526 | 10/1971 | Janning | 315/115 X |
| 4,147,947 | 4/1979 | Hoeh . | |
| 4,156,164 | 5/1979 | Yamagami et al. . | |
| 4,520,290 | 5/1985 | Cokefair | 313/15 |
| 4,547,467 | 10/1985 | Barth et al. | 313/518 X |

FOREIGN PATENT DOCUMENTS

| | | |
|---|---|---|
| 2932252 | 2/1981 | Fed. Rep. of Germany . |
| 122138 | 8/1979 | Japan . |

*Primary Examiner*—Palmer C. DeMeo

*Attorney, Agent, or Firm*—Zarley, McKee, Thomte, Voorhees & Sease

[57] ABSTRACT

A gas discharge display device comprises upper and lower substrates having anodes and cathodes thereon. An envelope is formed between the upper and lower substrates and includes an ionizable gas therein. A resistance heater element is placed on the lower substrate adjacent the cathode, and at layer of dielectric material is printed over both the cathode and the heater. The heater includes a pair of trimming elements which extend parallel to one another and which may be connected at any one of a plurality of points along their lengths to achieve the desired trimmed resistance value for the heater element.

7 Claims, 6 Drawing Figures

PLASMA DISPLAY HAVING HEATER AND METHOD OF MAKING SAME

BACKGROUND OF THE INVENTION

This invention relates to a plasma display having a heater and method for making same.

Gas discharge displays generally include an envelope formed between two spaced apart upper and lower substrates. Anodes are positioned on the under surface of the upper substrate and cathodes are positioned on the upper surface of the lower substrate. The envelope is filled with an ionizable gas such as neon and/or argon at low atmospheric pressures. Mercury vapor is also included within this envelope to impede ions from bombarding the cathodes and anodes while the display is on.

One problem encountered with gas discharge displays in a cold environment is that the mercury vapor sometimes condenses. This condensation usually occurs in temperatures which are below 0° C.

The addition of a heating element to the gas discharge or plasma display can increase its operational life and usable temperature range. This heater element can be incorporated as a part of the display package. Without a heating element, plasma displays can operate below 0° C. for only brief periods of time. This is due to the fact that the mercury vapor which is present in the plasma gas condenses out of the vapor phase. It is this mercury vapor which extends the display life of the plasma display and the loss of mercury in the vapor form can cause premature display failure. The addition of the heating element allows the mercury to stay in a vapor form when the ambient temperature outside the display is below 0° C., thereby allowing extended display operation below 0° C. An example of a type of heater used in plasma displays is shown in U.S. Pat. No. 4,520,290.

One disadvantage of the heated plasma display unit shown in U.S. Pat. No. 4,520,290 is the fact that a number of printing operations must be accomplished in order to assemble the unit. The heater element is printed on the lower substrate, and a first dielectric layer is superimposed over the heater element. The cathodes are then placed on top of the first dielectric layer and a second dielectric layer is printed over the cathodes. The printing of each dielectric layer is usually accomplished with two printing operations so that there will be two coats of dielectric with each layer.

Another disadvantage encountered with the device shown in U.S. Pat. No. 4,520,290 is the fact that two layers of dielectric are interposed between the heater elements and the gas within the display envelope. The superimposing of two separate dielectric layers between the gas and the heater elements has the effect of impeding or hindering the conduction of heat from the heater elements to the gas plasma within the envelope.

Therefore a primary object of the present invention is the provision of an improved plasma display having heater and method for making same.

A further object of the present invention is the provision of a plasma display wherein the heater resistor and the cathode segments may be constructed from the same material so that a separate heater material will not have to be stocked or procured in the manufacture of the device.

A further object of the present invention is the provision of an improved plasma display having heater wherein the heater resistor can be printed concurrently with the cathode segments, thereby eliminating the need for a separate screen printing for the heater and the cathode segments and further reducing the time required to make separate screen printings.

A further object of the present invention is the provision of a plasma display having heater wherein the cathode segments and their conductor lines do not cross over the heater resistor and its conductor lines, thereby eliminating the need for dielectric layers for insulation at the cross-over points.

A further object of the present invention is the provision of a plasma display having a heater wherein the time required to make the various prints is reduced because the number of printed layers is reduced.

A further object of the present invention is the provision of a plasma display wherein the cost of production is reduced over prior devices having heaters without changing the operaton or reliability of the display.

A further object of the present invention is the provision of a plasma display having heater which reduces the production labor, materials, set-up labor and production equipment needed to make the plasma display with a built-in heater.

A further object of the present invention is the provision of a trimming apparatus which permits the trimming of the resistance value of the heater element to the desired value.

A further object of the present invention is the provision of a plasma display having heater and method for making same which is economical in manufacture, durable in use and efficient in operation.

SUMMARY OF THE INVENTION

The present invention includes an upper and lower substrate which are sealed together in spaced apart relationship so as to provide a sealed envelope therebetween. The under surface of the upper substrate is provided with transparent anodes. A plurality of cathode segments are printed on the upper surface of the lower substrate, and at the same time, a resistance heater element is also printed on the upper surface of the substrate. The heater element can be made of the same conductive material as the cathode elements, thereby making it possible to print the cathode elements and the heater element on the substrate at the same time.

After the heater element and the cathode elements are printed on the upper surface of the substrate, a dielectric layer is printed over both the heater elements and the cathode elements. The dielectric layer includes a plurality of openings therein which correspond to the cathode elements, so that the cathode elements will be exposed to the plasma gas within the envelope between the upper and lower substrates.

The present invention eliminates the need for printing a dielectric layer between the cathode elements and the heater element as in prior art devices. Therefore, the present invention eliminates three printing steps from the process shown in prior devices, i.e., two printing steps for the elimination of one dielectric layer, and a third printing step by combining the printing of the cathode elements and the heater element in one printing operation.

The heater element includes a pair of trimming conductors which extend parallel to one another. A plurality of rung conductors extend between the two parallel trimming conductors at spaced apart points along the lengths thereof. Each rung conductor includes a small break therein so as to create an open circuit between the two spaced apart trimming conductors.

By placing a drop of conductive ink into one of the open areas of the rung conductors and firing it, a complete circuit between the two trimming conductors can be achieved. Different resistance values for the heater element can be achieved by selecting and shorting across the proper rung which will produce the correct resistance of the heater element. The process for trimming the heater element includes measuring the resistance of the two spaced apart portions of the heater element; calculating the surface resistance of the two parts of the heater element; selecting which rung element should be shorted to achieve the correct total resistance; and shorting that rung by placing a drop of conductor ink in the break of the rung and firing it.

DETAILED DESCRIPTION OF THE PREFERRED EMBODIMENT

Figure 1:
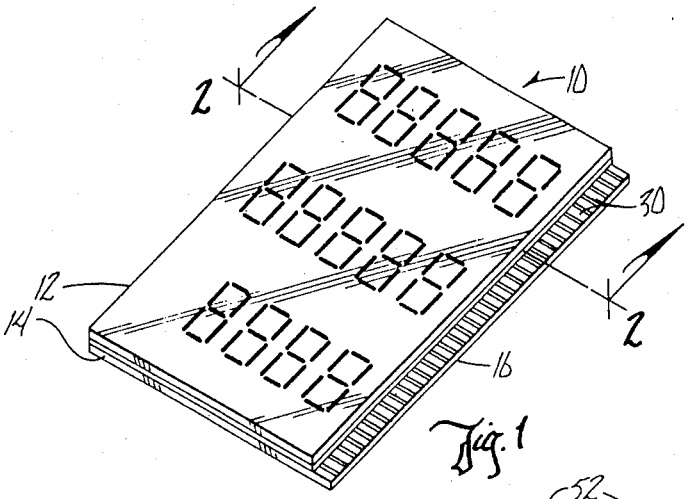
FIG. 1 is a perspective view of the plasma display of the present invention.

Referring to the drawings, the numeral 10 generally designates the plasma display of the present invention. Display 10 comprises an upper glass substrate 12 and a lower substrate 14 which may be glass or other dielectric material. Lower substrate 14 is slightly larger than upper substrate 12 so that a protruding edge 16 of lower substrate 14 extends outwardly beyond upper substrate 12. A small hole 18 extends through lower substrate 14 and a glass node or nodule 20 is in covering relation over the bottom of hole 18. Positioned within the cavity formed by glass node 20 is a small mercury capsule 22.

Printed on the upper surface of lower substrate 14 are a plurality of cathode segments 24, a heater element 26, a plurality of keep alive elements 28, and a plurality of contact pads 30 along the edge 16 of lower substrate 14. The cathode elements 24 are arranged in typical numeric or alpha numeric arrangement as is well known in the art. Extending from the various cathode elements 24 are a plurality of cathode conductors 32, each of which leads to a separate one of the contact pads 30. The cathode conductors 32 are identical for each of the three rows of alpha numeric characters shown in FIG. 4, and therefore, for clarity they are shown only for the top row of characters.

The heater element 26 comprises an elongated resistance element which has one end connected to a heater contact pad 34 and which has the opposite end connected to a second heater contact pad 35. The heater element 26 is folded back upon itself several times between the various rows of cathode elements 24 so as to provide a resistance heating element adjacent, but laterally displaced from the cathode elements 24.

Included within the heater element 26 are a pair of trimming conductors 36 and 38 which are parallel to one another and spaced apart from one another. A plurality of rung conductors 40 extend between trimming conductors 36 and 38, and each rung conductor 40 includes a small break 42 therein which forms an open circuit between the two trimming conductors 36 and 38.

During the manufacture of the device, the resistance value of trimming element 36 and that portion of heater element 26 thereabove is measured and similarly the resistance of trimming element 38 and that portion of heater element 26 therebelow is also measured. From these measured resistances, it is possible to calculate the surface resistance of the element and calculate which rung should be shorted in order to achieve the desired total resistance for heater element 26. Once that particular rung 40 is selected, a drop of conductor ink is placed over the break 42 in that rung 40, thereby shorting across the two trimming conductors 36 and 38 at the selected rung 40. This creates the desired resistance value for heater element 26. The keep alive elements 28 are interconnected by keep alive conductors 44, each of which leads to a keep alive contact pad 46.

One important feature of the various elements printed on the upper surface of substrate 14 is that none of the elements cross over one another. This eliminates the need for printing any of the elements separately, and makes possible the printing of all the elements shown in FIG. 4 on the upper surface of substrate 14 in a single printing operation. While various metal conductors can be used for the elements printed on the upper surface of substrate 14, the preferred material is a nickel thick film material.

Figure 4:
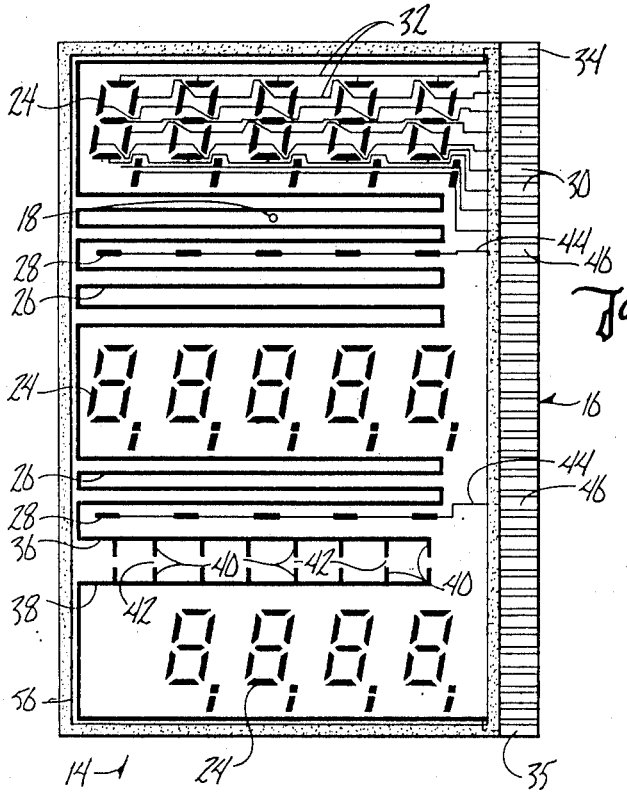
FIG. 4 is a plan view showing the lower substrate having the heater element and the cathode elements printed thereon.
Figure 5:
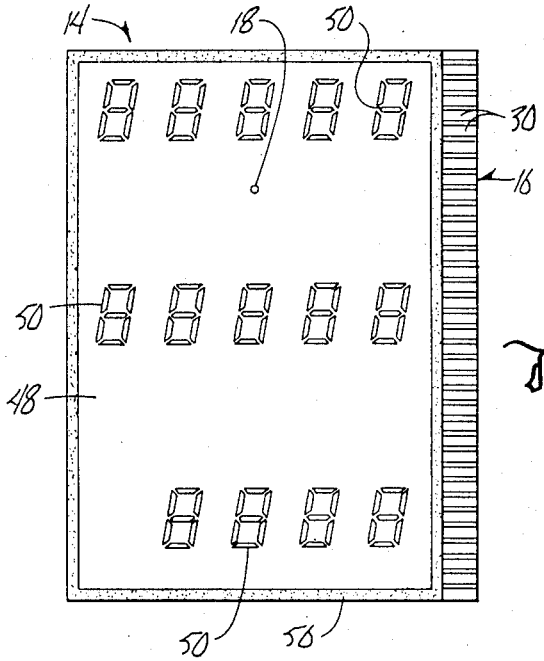
FIG. 5 is a view similar to FIG. 4A, but showing the device after the dielectric layer has been printed thereover.
Figure 6:
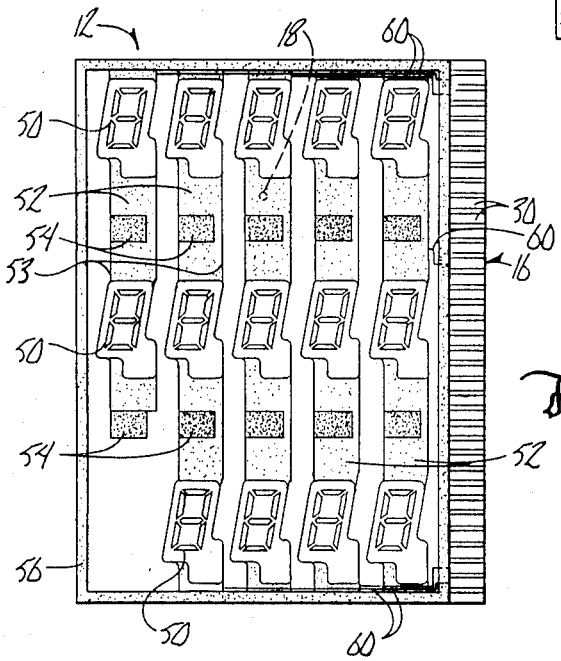
FIG. 6 is a top plan view of the plasma display fully assembled.

After printing the various elements shown in FIG. 4 on the upper surface of substrate 14, a dielectric layer 48 is printed over the cathode elements 24, the heater element 26, and the keep alives 28. It is preferred that two thicknesses of dielectric be printed in order to create dielectric layer 48. Layer 48 has a plurality of cathode apertures 50 which are aligned over the cathode elements 24 so as to permit the exposure of the cathode elements 24 through dielectric layer 50.

A plurality of anode elements 52 are printed on the bottom surface of upper substrate 12 in conventional fashion. The anode elements 52 are transparent so that the glow of the cathode may be seen from above the plasma display. Preferably a thin layer of tin oxide is used for anode 52. Because tin oxide is a relatively polar conductor, a thin line of nickel anode conductor 53 extends around the perimeter of each anode element 52 so as to insure good electrical contact. Connected to anode conductors 52 are a plurality of keep alive covers 54 which are opaque and which are positioned in covering relation over keep alives 28 so that the glow between the keep alive elements 28 and the anodes 52 are not visible from the exterior of the plasma display.

Figure 2:
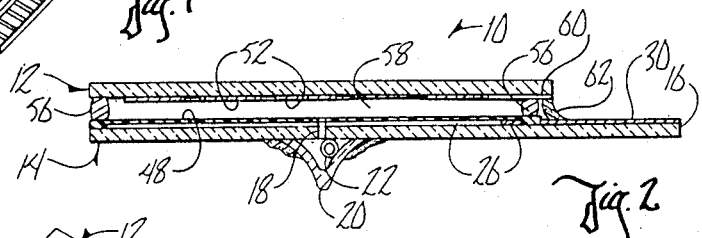
FIG. 2 is a sectional view taken along line 2—2 of FIG. 1.
Figure 3:
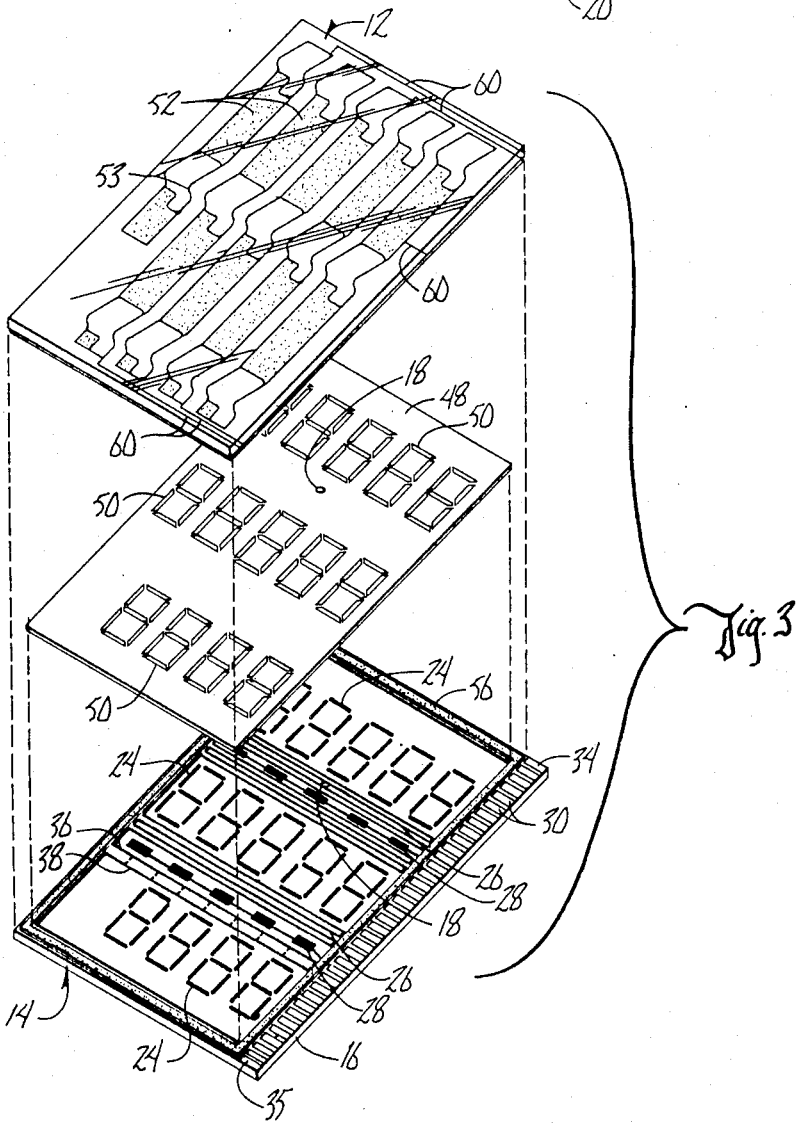
FIG. 3 is an exploded perspective of the various layers in the plasma display.

Upper glass 12 is attached to lower substrate 14 by a solder glass material 56 which extends around the perimeter of dielectric layer 50. Solder glass 56 provides a sealed envelope 58 between the anode elements 52 and the dielectric layer 48. It should be noted that anode conductors 54 include anode leads 60 which extend outwardly beyond solder glass 56 and which are connected to three of the contact pads 30 on the protruding edge 16 of lower substrate 14 by means of a conductive epoxy 62 (FIG. 2).

The nodule 20 is formed by a glass tube which is in communication with hole 18. The air is evacuated out of envelope 15 through the glass tube (not shown), and an ionizable gas such as neon or argon or a mixture thereof is placed within the envelope 58. Then the glass tube is closed off to form the nodule 20. The device is heated so as to cause the mercury capsule 22 to burst and vaporize so that the mercury vapor passes through hole 18 into the envelope 58 and mixes with the gas plasma therein.

The heater element 26 is actuated to cause heat to radiate upwardly through dielectric layer 48 and thereby heat the gas plasma within the envelope 58. A thermostat (not shown) may be connected to the heater element 26 to control the operation thereof, and to insure that the heater element is actuated whenever the ambient temperature reaches a temperature likely to cause the mercury vapor to condense. Preferably the heater element should be actuated so as to prevent the mercury vapor from cooling below 0° C.

The present invention has several advantages over the prior art. The heater resistor and the cathode elements may be made from the same material. Therefore, a separate heater material is not required to be stocked or procured.

The heater resistor can be printed concurrently with the cathode segments, thereby eliminating the need for separate screen printing operations and thereby minimizing the time required for such separate screen printings.

The present invention eliminates the need for dielectric prints commonly used in the prior art for insulating various cross-over conductors on the substrate. The present invention does not include any cross-overs between the heater element and the cathodes or keep alive elements on the substrate. Therefore, cross-overs are eliminated and the need for insulating cross-overs is also eliminated.

The trimming conductors 36 and 38, together with the rung conductors 40 provide a simple and efficient means for trimming the resistance value of the heater element to the desired value.

Thus, it can be seen that the device accomplishes at least all of its stated objectives.

What is claimed is:

1. A gas discharge display device comprising:

a lower substrate and an upper glass substrate;

sealing means joining said upper and lower substrates together in spaced apart relation to form a sealed envelope therebetween;

an ionizable gas filling said envelope;

at least one anode on said upper substrate and within said envelope;

at least one cathode segment positioned on said lower substrate and within said envelope;

heater means separate from said cathode segment on said lower substrate, said heater means being positioned adjacent said cathode segment and within said envelope;

a layer of dielectric material overlying both said heater means and said cathode segment, and having at least one cathode opening therein exposing said cathode segment to said ionizable gas within said envelope;

said layer of dielectric material covering and electrically insulating said heater means from said ionizable gas so that said heater means does not affect light discharge between said anode and said cathode segment, said heater means being capable of radiating heat through said dielectric layer to maintain said ionizable gas at a predetermined minimum temperature when the external ambient temperature is below said predetermined minimum temperature.

2. A gas discharge display acording to claim 1 wherein said layer of dielectric material is the only layer of dielectric material within said envelope.

3. A gas discharge display according to claim 1 wherein said heater means is positioned horizontally spaced from said cathode segment.

4. A gas discharge display according to claim 1 wherein heater conductor means extend from said heater means to outside said envelope and cathode conductor means electrically separate from said heater conductor means extend from said cathode segment to outside said envelope, there being no overlapping of said heater means and said heater conductor means with said cathode segment and said cathode conductor means.

5. A gas discharge display according to claim 4 wherein said heater conductor means comprises trimming means for trimming the combined electrical resistance of said heater means and said heater conductor means.

6. A gas discharge display according to claim 5 wherein said trimming means comprise first and second conductor elements, each having an elongated portion, said elongated portions of said first and second conductor elements being arranged in close spaced apart relation to one another, said first conductor element being connected to said heater means and said second conductor element leading outside said envelope, a plurality of rung conductors extending between said spaced apart elongated portions of said first and second conductor elements, said rung conductors being spaced apart from one another along the length of said elongated portions of said first and second conductor elements, each of said rung conductors having a break therein so as to create an open circuit between said first and second conductor elements, a short conductor spanning said break of a preselected one of said rung conductors chosen to produce a preselected trimmmed combined resistance value for said heater means and said heater conductor means.

7. A gas discharge display device made according to the method comprising:

placing a plurality of cathode elements on the upper surface of a lower substrate in a predetermined pattern;

placing a heater element on said upper surface of said lower substrate in a position adjacent and horizontally displaced from said cathode elements, said heater element being electrically separate from said cathode elements;

placing a layer of dielectric material over both said cathode elements and said heater element, said dielectric material having cathode openings therein for exposing said cathode elements upwardly through said layer of dielectric material, said dielectric material completely covering said heater element;

sealing an upper substrate in upwardly spaced relation to said upper surface of said lower substrate so as to form a sealed envelope between said upper and lower substrates, said upper substrate having at least one anode element thereon positioned within said envelope;

filling said envelope with an ionizable gas so that said cathode elements are exposed through said cathode openings in said dielectric material and said heater element is not exposed to said gas;

actuating said heater element to cause heat to radiate through said dielectric material to maintain said gas within said envelope at a predetermined minimum temperature.

* * * * *